US005680433A

United States Patent [19]

Jensen

[11] Patent Number: 5,680,433

[45] Date of Patent: Oct. 21, 1997

[54] HIGH OUTPUT STATIONARY X-RAY TARGET WITH FLEXIBLE SUPPORT STRUCTURE

[75] Inventor: David K. Jensen, San Jose, Calif.

[73] Assignee: Varian Associates, Inc., Palo Alto, Calif.

[21] Appl. No.: 624,143

[22] Filed: Mar. 25, 1996

Related U.S. Application Data

[63] Continuation of Ser. No. 430,682, Apr. 28, 1995, abandoned.

[51] Int. Cl.[6] ..... H01J 35/10

[52] U.S. Cl. ..... 378/141; 378/143; 378/130

[58] Field of Search ..... 378/121, 122, 378/126–128, 130, 139, 141, 142, 119, 143

[56] References Cited

U.S. PATENT DOCUMENTS 3,609,432 9/1971 Shimula ..... 378/143

3,836,804 9/1974 Frens et al. ..... 313/60

FOREIGN PATENT DOCUMENTS 2089109 12/1980 United Kingdom .

*Primary Examiner*—Don Wong

*Attorney, Agent, or Firm*—Bella Fishman

[57] ABSTRACT

A stationary target anode of an X-ray device is provided, having stepped high Z button configuration. By minimizing the diameter of the central, X-ray producing section of the button, and incorporating a thin lip extending therefrom to a diameter approximately twice that of the central portion, internal and interface stresses are minimized. A flexible structure is also provided to support the button/substrate assembly and provide minimal resistance as the substrate radially expands during heating, thereby minimizing induced stress on the target and preventing fatigue and failure of the support target.

13 Claims, 11 Drawing Sheets

Section A–A

Section B–B

HIGH OUTPUT STATIONARY X-RAY TARGET WITH FLEXIBLE SUPPORT STRUCTURE

This is a continuation of application Ser. No. 08/430,682, filed on Apr. 28, 1995, now abandoned.

FIELD OF THE INVENTION

The present invention is directed to liquid cooled anode X-ray generating devices, and in particular to stationary anode X-ray devices having an anode target plate and support structure of unique design to reduce the stresses generated in the high Z anode material and interface stresses produced as a result of the high temperature created during X-ray generation.

BACKGROUND OF THE INVENTION

It is well known that for X-ray production at any given electron energy there exists an optimum thickness for the high Z target material. Typically, for stationary targets, the high Z button of the target is either: (1) bonded directly to a low Z, water cooled substrate, typically copper or some alloy thereof; or (2) bonded to a support at the periphery of the button. Generally, the button thickness chosen for a particular electron energy is insufficient to completely stop the X-ray producing electrons, and the low Z substrate, whether heat sink or not, serves the secondary purpose of beam stop, thereby preventing the transmission of contaminating electrons. From the physics point of view it is this appropriate combination of high Z button and low Z substrate which enables the production of useful X-rays.

The production of X-rays, however, is an inherently inefficient process, resulting in copious amounts of heat generated as a direct by-product. The elevated target operating temperatures lead to thermal fatigue of the target structure. This situation is exacerbated in X-ray applications where the power levels and dose rates are higher than those generally used.

Prior art solutions for long-life stationary targets have focused on improving the cooling systems. One example of such a system is found in U.S. Pat. No. 4,455,504 to Iversen, which describes a liquid cooled stationary target X-ray tube having a contoured surface of a predetermined, varying geometry on the anode's heat exchange surface to promote nucleate boiling and bubble removal. Another example is found in U.S. Pat. No. 3,914,633 to Diemer et al, which describes a means for improving heat transfer by minimizing the thickness of the heated section and by increasing the area of the cooled surface. The teaching provided by Iversen and Diemer et al, as well as other known improvements, focus on curing the results of elevated target temperature by improving the cooling of the target rather than addressing the issue of the failure of the target and its support structure due to resulting deformations. Prior designs have ignored this aspect, focusing more on the radiological and thermal aspects of the design.

SUMMARY OF THE INVENTION

The present invention provides a stationary X-ray target of unique design, which enhances cooling while minimizing stress in the high Z button and low Z substrate. The operating life of the target is thus improved. The high Z anode button has a central X-ray producing section which is reduced in diameter, in conjunction with a thin lip which forms the interface with the supporting substrate; wherein the lip has a diameter approximately twice that of the central portion. A target so configured minimizes both the internal stresses in the high Z button material, as well as the interface stresses, created as a result of the heat generated during X-ray production. The present invention also provides a flexible support structure to house the target anode and substrate, and allow the target anode to radially expand as it is heated, with minimal restriction; thereby preventing the creation of fatigue cracks in the internal walls of the support structure which could compromise the water-to-vacuum or air-to-vacuum integrity of the walls.

It is therefore an object of the present invention to provide a new target anode design which departs from the constant diameter designs presently used, and is based upon an analysis of failure modes and mechanisms.

It is another object of the invention to create an improved support structure having minimal stiffness and rigidity, and which avoids inducing additional stress in the target as it radially expands during heating.

It is a feature of the present invention that the unique target geometry and support structure allows for long term, reliable X-ray production at target power levels and dose rates at least twice those currently in use.

DETAILED DESCRIPTION OF THE INVENTION

One of the primary disadvantages of bonding a high Z button of conventional design directly to a low Z, liquid cooled substrate is the mismatch in the thermal expansion and stiffness between the high Z button and the low Z substrate. Thermal fatigue, in both the high Z button and low Z substrate, quickly becomes a problem as a result of this mismatch. A target of this configuration may survive for a limited period of time, but will eventually fail as a result of the detrimental distribution of stress induced within the button, substrate and their support. The use of a conventional support is likewise disadvantaged in that the liquid cooling, as presently used, is unable to adequately cool the target at the elevated power levels contemplated for use with the present invention. Further, higher levels of stress are induced by the rigidity of the support structure.

By utilizing extensive finite element analysis and testing to study the modes of failure of conventional target, excellent correlations between both the thermal and structural analyses, and the measured and observed target performance have been obtained. As a result, the studies show that by increasing the diameter of the high Z button, a reduction in the interface stress is achieved, but with a resulting increase in the stress within the high Z button itself, to the point of premature failure of the button. Conversely, a reduction in the diameter of the high Z button results in a reduced stress, but with a corresponding increase in stress at the substrate interface, so that fatigue at the interface becomes the primary failure mechanism. In accordance with one aspect of the present invention, the geometry of the high Z button is altered, in response to the analysis of the failure modes and mechanisms, to reduce stress in these two critical regions.

Figure 1A:
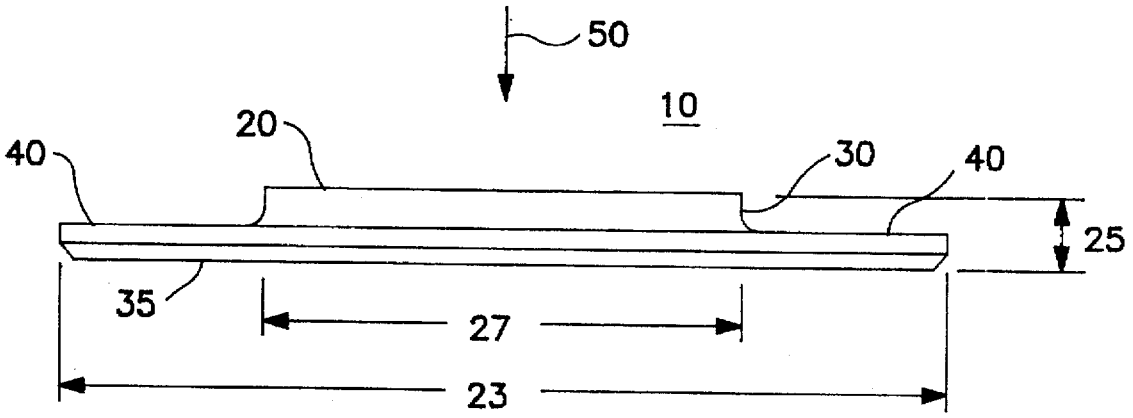
FIG. 1*a* is a side view of the target anode button according to the present invention.
Figure 1B:
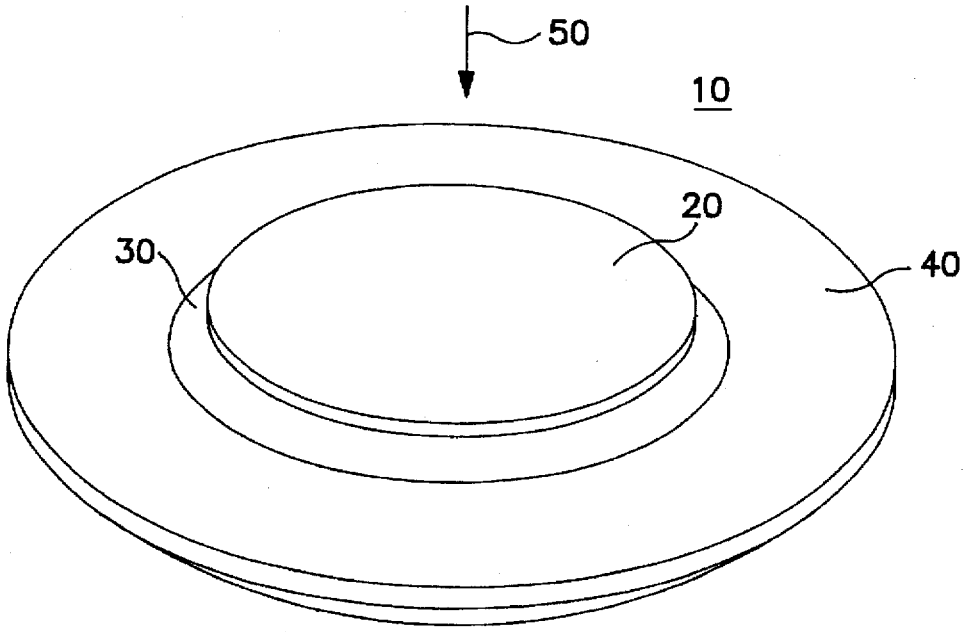
FIG. 1*b* is an elevated oblique of the target anode button depicted in FIG. 1*a*.

Referring now to FIGS. 1*a* and 1*b*, a target button 10 is shown, having a stepped configuration. Stress in the X-ray producing section 20 is reduced by minimizing the overall thickness 25 of the button to that which is necessary for X-ray production, and reducing the diameter 27 of the X-ray producing region of the button by incorporating step interface 30. It is recognized by those skilled in the art that thickness 25 will be application dependent and is primarily based upon incident electron energy of the beam. Stress is likewise reduced at the interface 35 between the high Z button and the low Z substrate (not shown), by spreading the interface over a larger region through lip section 40, whose diameter extends beyond step 30 a distance such that the overall diameter of the button is approximately twice diameter 27 of the X-ray producing section. A target button so configured, when heated at its central location as a result of electron beam 50, will reduce both the high Z button and substrate interface stresses created as a result of said heating.

Figure 2:
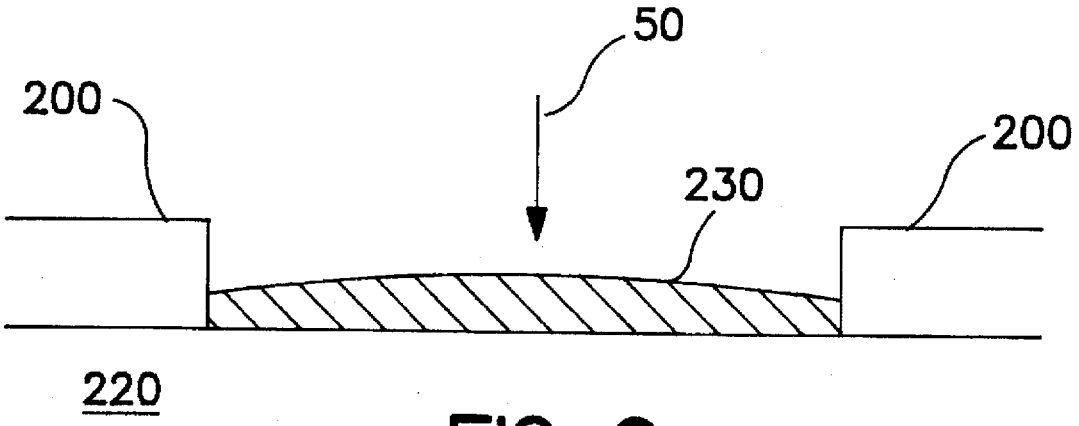
FIG. 2 is an alternative embodiment of the target anode button according to the present invention manufactured by a chemical vapor deposition process.
Figure 3:
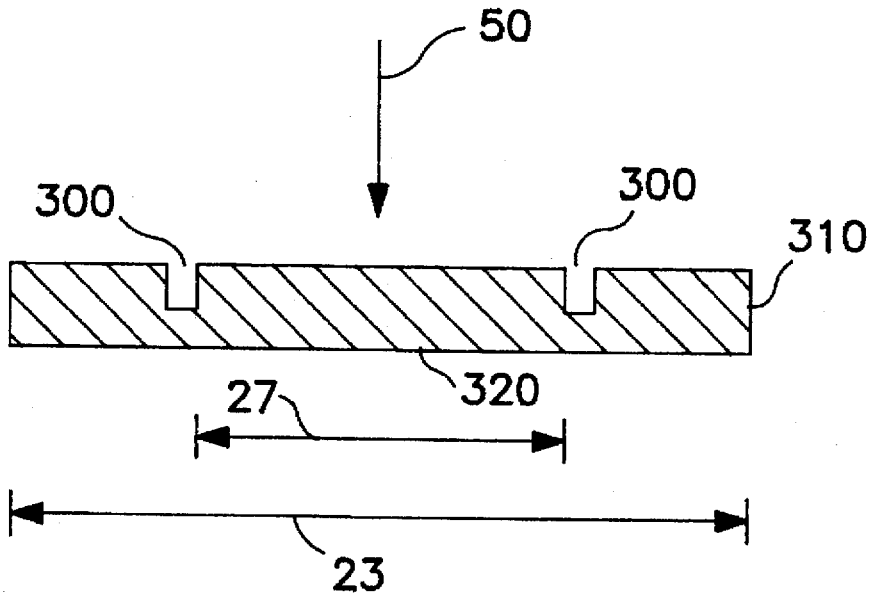
FIG. 3 is still another alternative embodiment of the target anode button in accordance with the present invention.

In an alternative embodiment, as shown in FIG. 2, similar geometric configuration may be obtained by providing masking elements 200 on substrate 220, and using a chemical vapor deposition (CVD) process, such as those well known in the art, to create region 230 of the dimensions herein described. As shown in FIG. 3, an expansion gap 300 is created in a high Z button 310 such that diameter 23 is approximately twice that of diameter 27. By utilizing expansion gap 300, stress in the high Z button is kept low while the interface area 320 is increased.

In finite element (FE) computer analysis a solid continuum is subdivided into smaller subregions, or elements, which are connected along their boundaries and at their corners by points called nodes. The material properties of the solid and the governing relations for the specific type of analysis are considered by the code and expressed in terms of unknowns at the nodes. An assembly process which considers applied loads and boundary conditions results in a system of simultaneous equations, which when solved, yields an approximate behavior of the structure. For the analysis conducted, a commercially available code is used. The code was checked by test and correlation of computed results with observed X-ray target behavior (Cook, Robert D. Concepts and Applications of Finite Element Analysis, John Wiley & Sons, 2nd ed. 1981 for a description of the Finite Element method).

Figure 4:
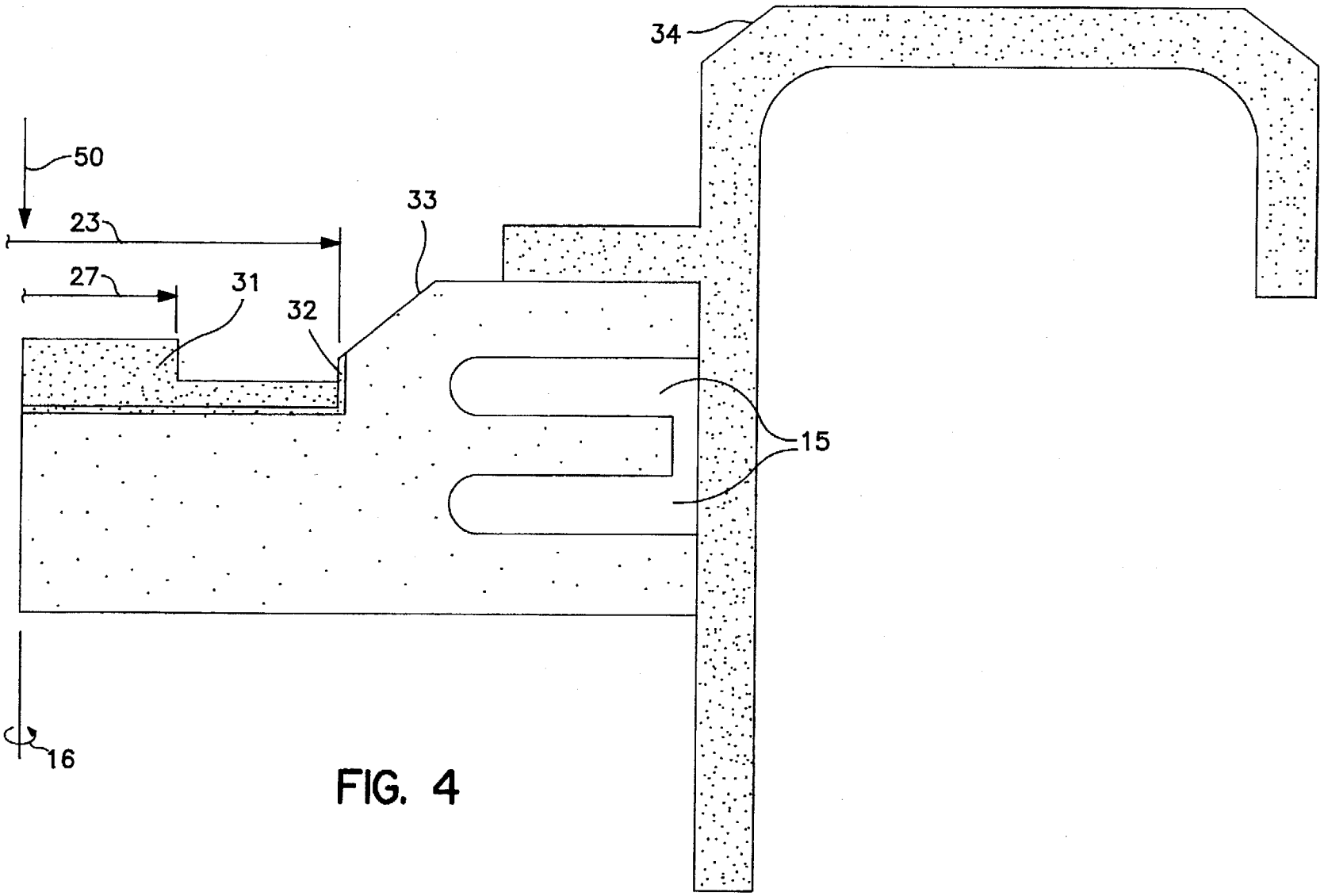
FIG. 4 is a finite element analysis mesh representative of the support structure and target anode button in accordance with the present invention.

Because of its circular symmetry, the target was modeled as a 2-D axisymetric section. Material properties, heat loading from beam impact and convection cooling were added to complete the model. A typical FE mesh is shown in FIG. 4. Location of beam impact 50, water cooling channels 15 and axis of revolution 16 are also shown.

The stepped button geometry was arrived at by recognizing and satisfying the following conditions: 1) reducing button diameter reduces the magnitude of stress in the button, and 2) increasing button diameter reduces the magnitude of stress in the substrate at button edge. Additionally, the full thickness of button is necessary only in the region of beam impact.

Both of the above conditions can be satisfied by providing a stepped button with the center X-ray producing region of necessary thickness and a thin lip extending therefrom to reduce the stress in the substrate. With this design, the maximum stress in the button is now acceptably low, and the likelihood of failure in the substrate at button edge is eliminated.

In order to further optimize the reduction of stress in the target, another aspect of the present invention is flexible support structure 400 as shown in FIGS. 5 *a–f*. Prior art designs have focused on radiological and thermal aspects of the support design, ignoring the flexibility of the support structure. During X-ray generation, heating induced stresses are not restricted to the vicinity of beam impact in the button or in the substrate. Deformations resulting from elevated temperatures occur throughout the target structure. Therefore, if the structure is overly constrained high stress and thermal fatigue result. Fatigue cracks in the support structure and substrate can potentially propagate through a vacuum wall, creating vacuum leaks. Additionally, thermal fatigue of the high/low Z interface can result in loss of thermal contact and ultimate failure. Support structure 400 allows free expansion of the substrate during operation. The above referenced examples included, as part of the analysis, a structure as herein described to support the substrate and high Z button, thereby evidencing the unique feature of the combined aspects of the present invention.

Figure 5A:
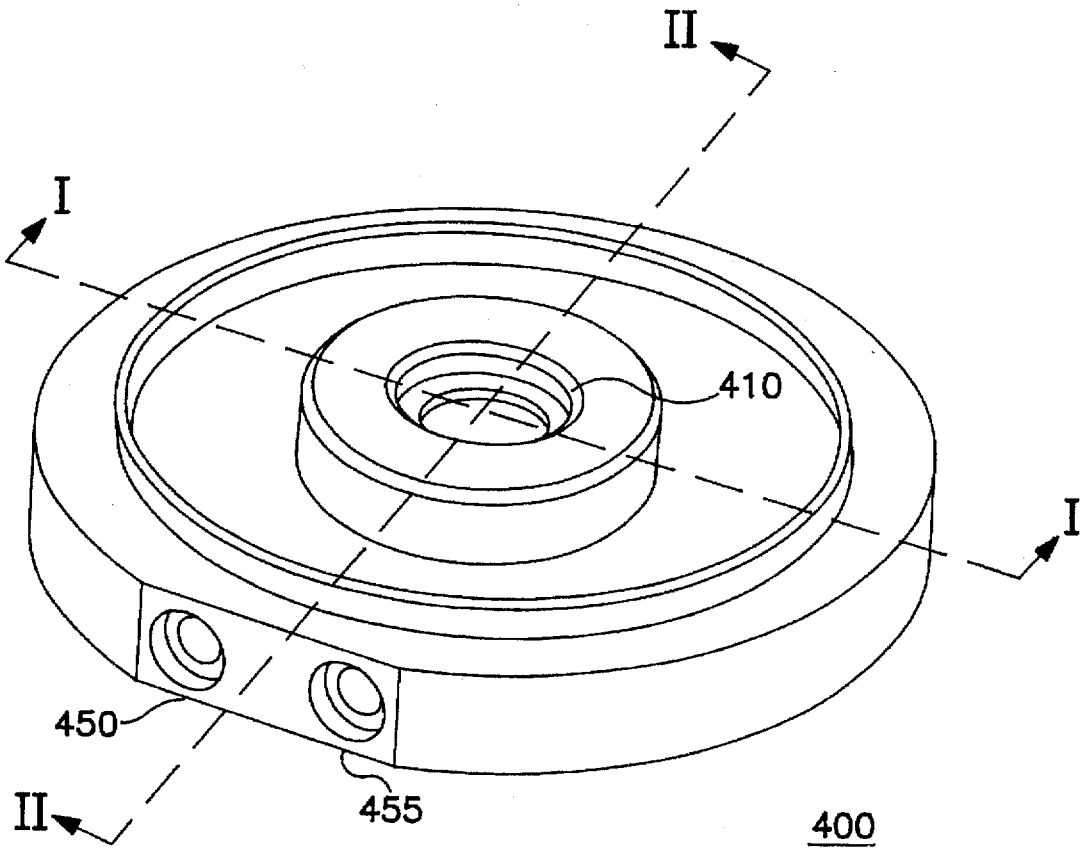
FIG. 5*a* is an elevated oblique view of the flexible support structure in accordance with the present invention.
Figure 5B:
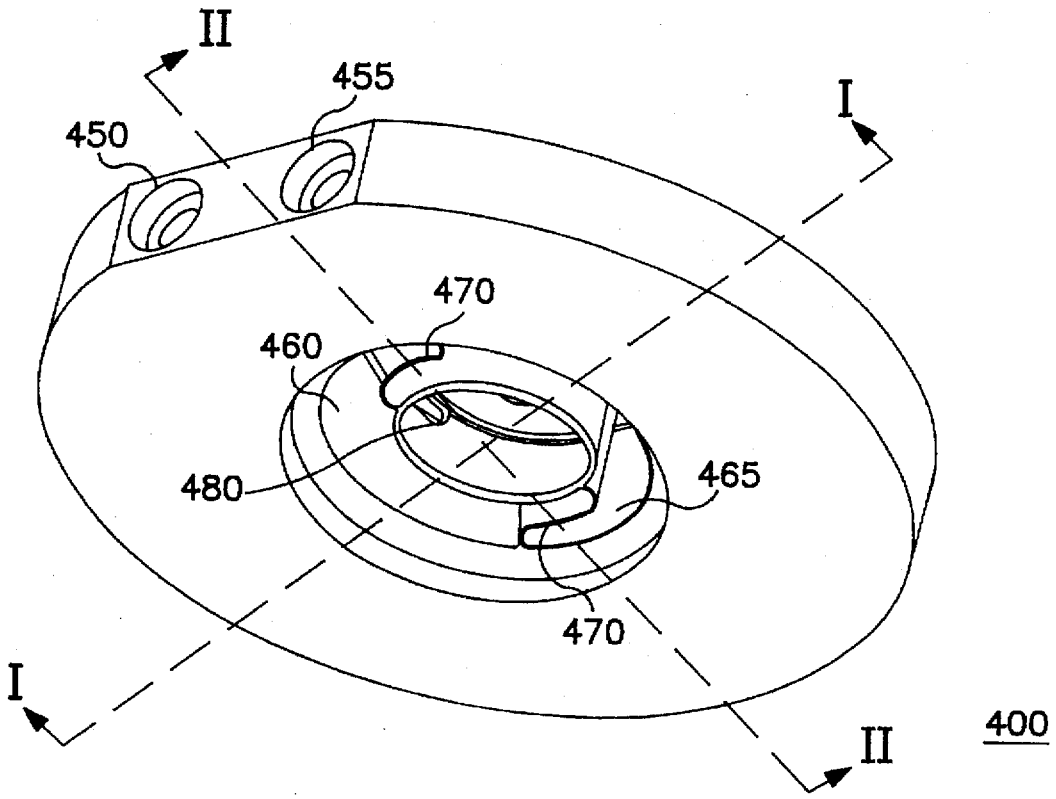
FIG. 5*b* is a bottom oblique view of the flexible support structure in accordance with the present invention.
Figure 5C:
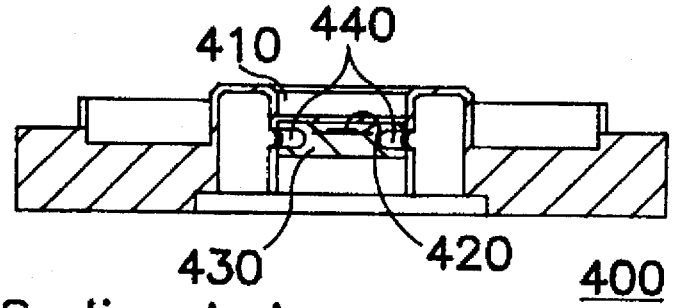
FIG. 5*c* and 5*d* are sectional views of the flexible support structure in accordance with the present invention.
Figure 5D:
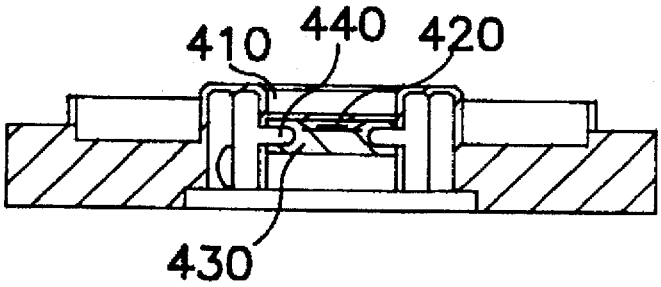

Referring now to FIG. 5*a*, aperture 410 is provided for the target button of the present invention. In FIG. 5*c* and FIG. 5*d*, representations of the support structure of the present invention along section lines I—I and II—II of FIGS. 5*a, b* respectively, high Z button 420 of the present invention is shown bonded to low Z substrate 430, such as copper. Substrate 430 is of conventional design well known in the art, having integral coolant channels 440, whose location is optimized utilizing FE technique as provided herein to allow the water or other cooling media to flow as close as possible to the heated target without allowing the temperature of the inner walls of the channels to exceed the boiling point of the fluid. This substrate button assembly is then incorporated into flexible support structure 400 of present invention.

Figure 5E:
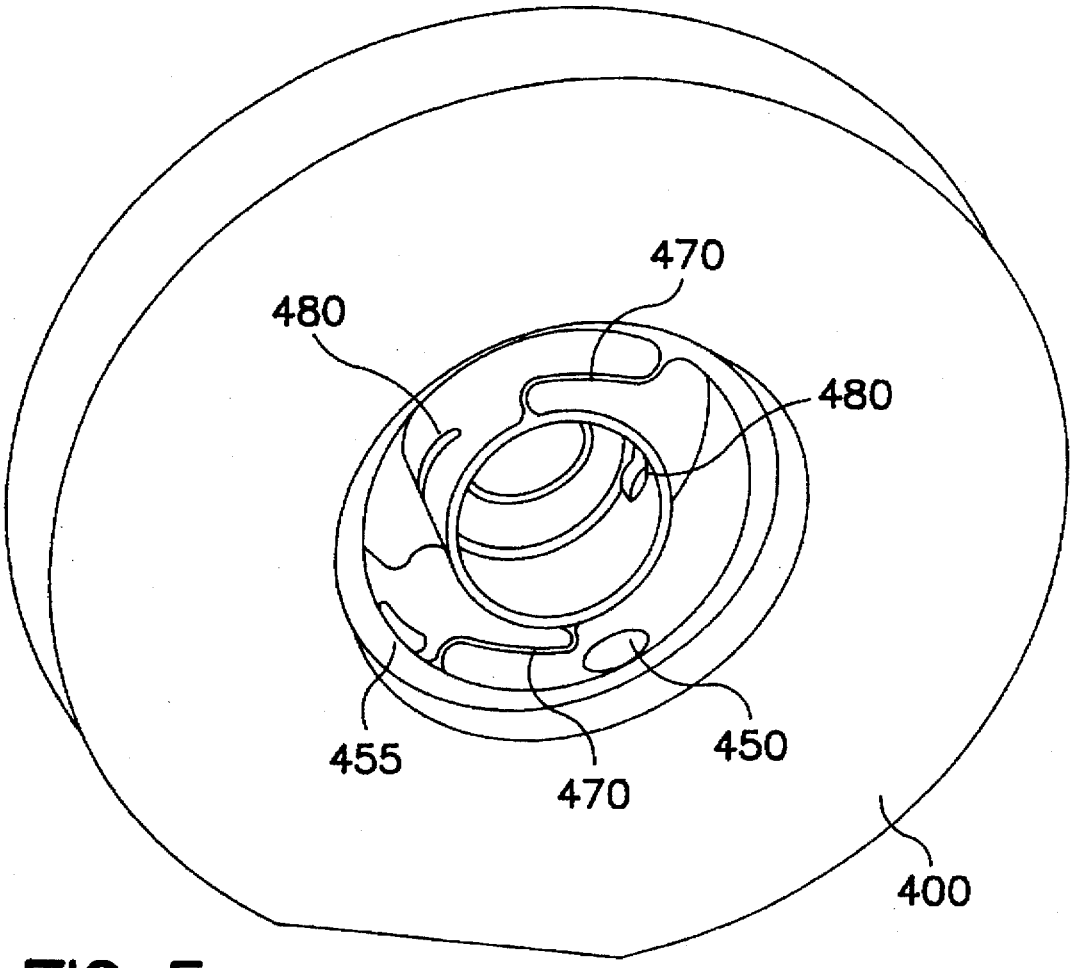
FIG. 5*e* is a bottom oblique view of the flexible support structure in accordance with the present invention.
Figure 5F:
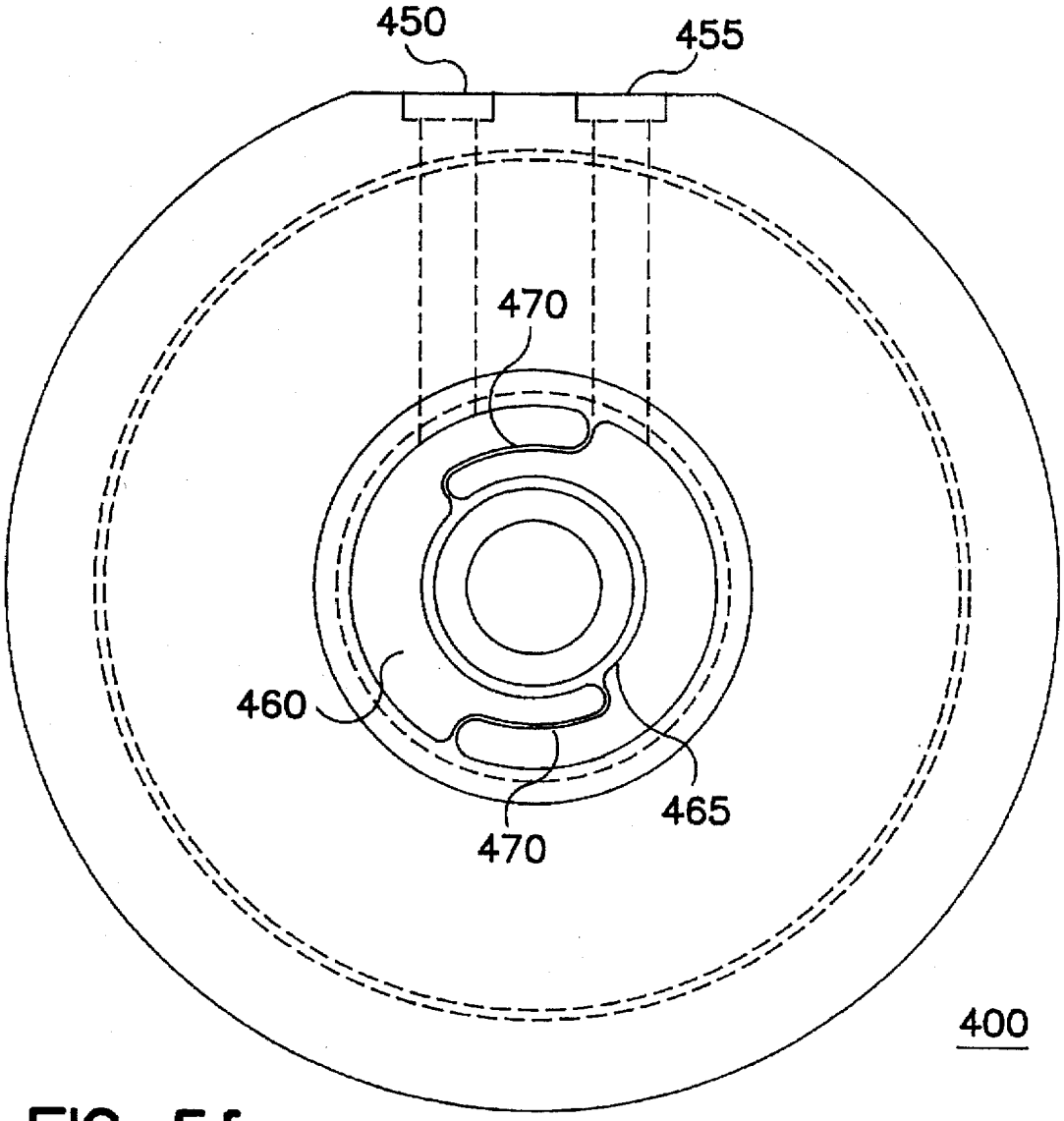
FIG. 5*f* is a bottom view of the flexible support structure in accordance with the present invention.

Referring now to FIG. 5*f*, support structure 400, minus the substrate button assembly, is shown to provide a more detailed representation of the unique aspects of the present invention. Structure 400 is preferably manufactured from a solid piece of SST (stainless steel), incorporating an integral coolant supply channel 450 and return channel 455, which are operably coupled to a pair of supply and return plenum chambers, designated as elements 460 and 465 respectively. Stainless steel is preferred in view of its ability to be easily welded without the need for a separate weldable member, and the ability to minimize wall thickness for structural flexibility without sacrificing vacuum integrity. Supply plenum chamber 460 is separated from return plenum 465 by an arrangement of flexible baffles 470. Horizontal slots 480, shown in FIG. 5e, are machined into the inner walls of the plenum chambers to supply coolant to the low Z substrate (not shown) via substrate coolant channels 440, as discussed. All support structure wall thicknesses are minimized to maintain maximum flexibility. One skilled in the an will recognize that the specific wall dimensions will be material, process and application dependent.

The "S" configuration of baffle elements 470, which separate the plenum supply chamber 460 from the return chamber 465, provide maximum flexibility and minimal restriction during radial expansion of the target as a result of heating during X-ray generation. Coolant supplied by channel 450 flows to slot 480 where it encounters substrate 430, and subsequently splits as it enters substrate coolant channel 440. Coolant flows equally around both sides of the heated section of the substrate, where it ultimately recombines for flow into return plenum chamber 465 via slot 480, for return through channel 455.

Figure 6A:
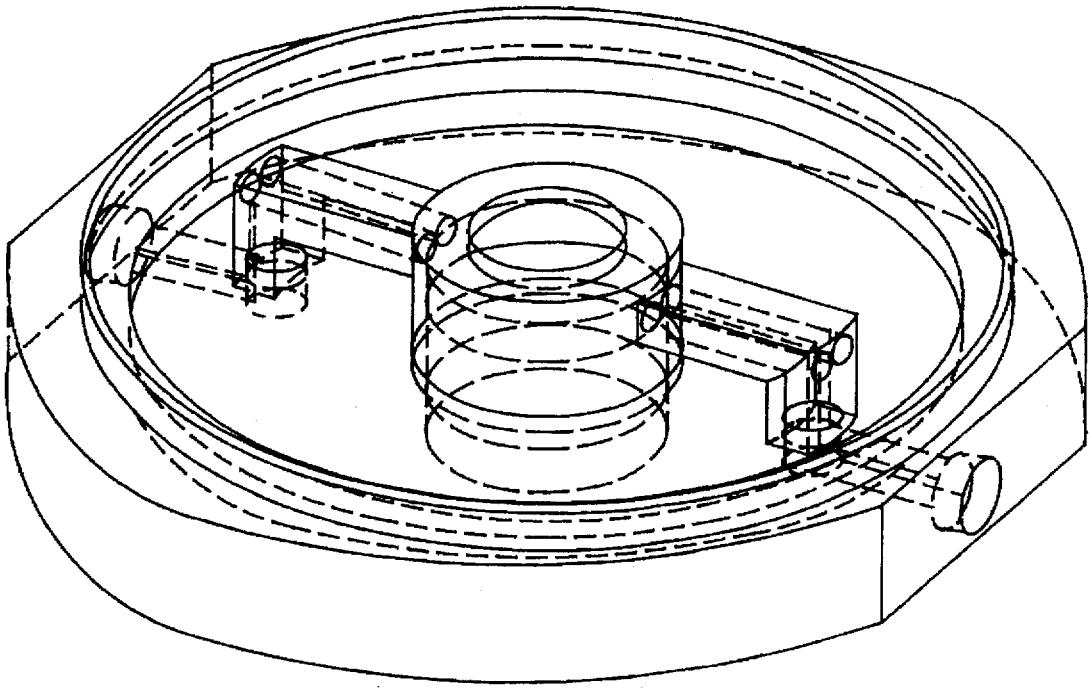
FIG. 6*a* is an alternative embodiment of the flexible support structure in accordance with the present invention.
Figure 6B:
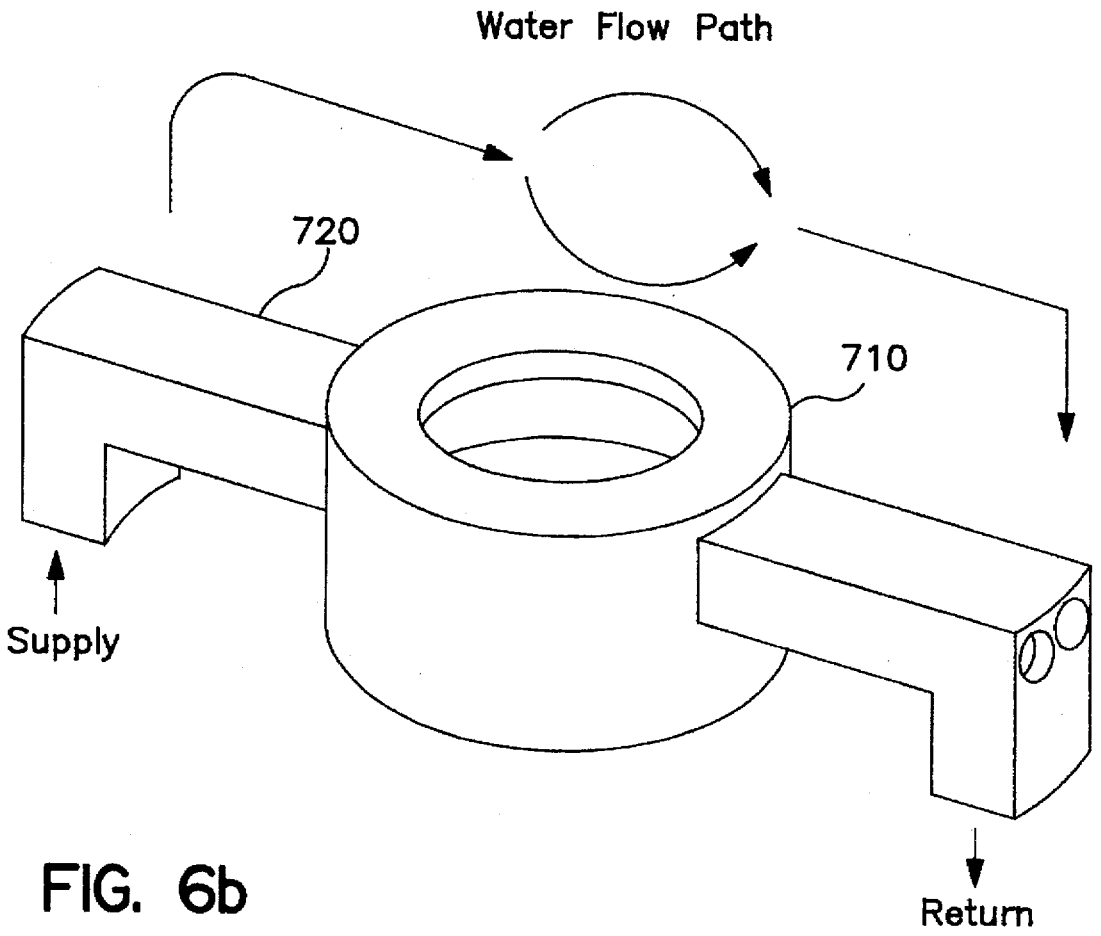
FIG. 6*b* is a close-up representation of the flexible manifold configuration of the alternative embodiment depicted in FIG. 6*a*.
Figure 6C:
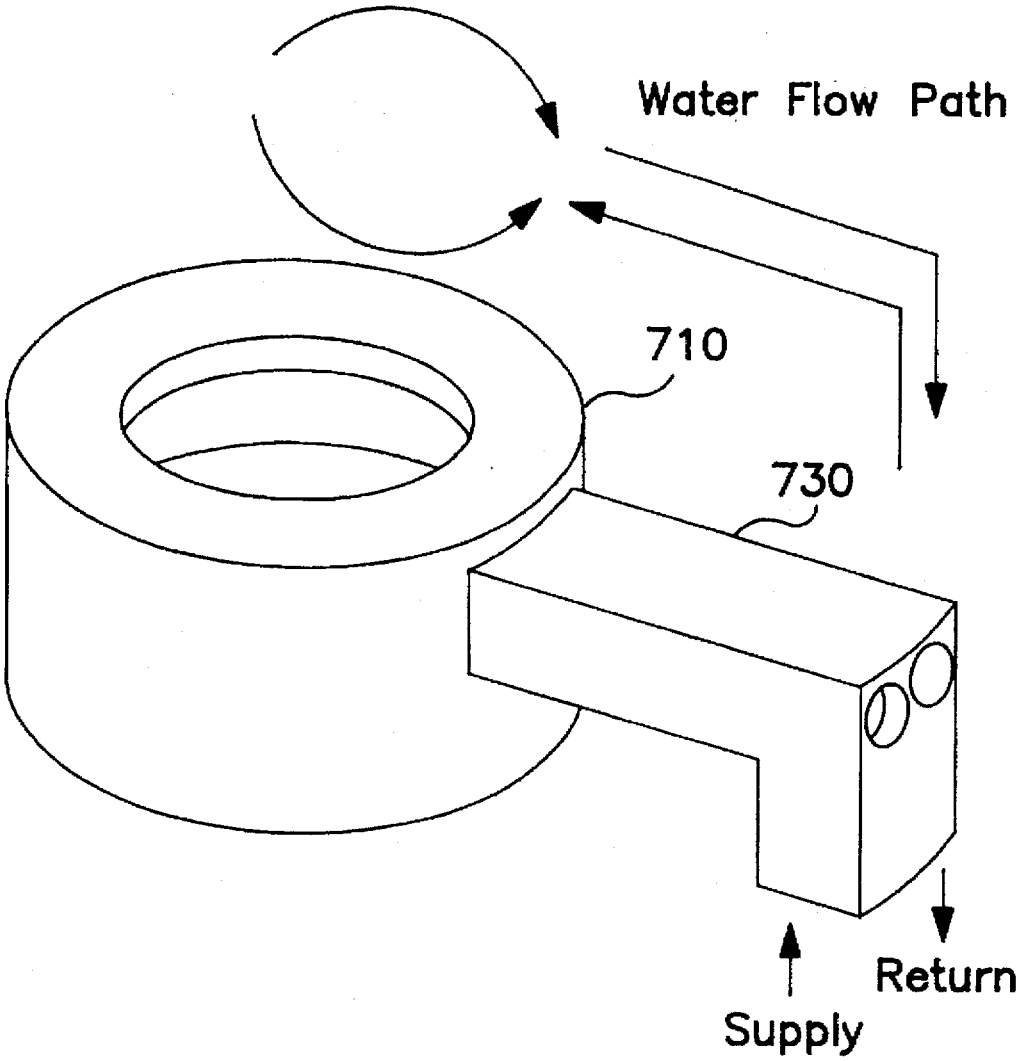
FIG. 6*c* is an alternative manifold configuration for the embodiment represented in FIG. 6*a*.

In an alternative embodiment, as shown in FIG. 6a, the plenum chambers are replaced by a cylindrical support 710, having cooling channels disposed therein. Support 710 upholds the high Z button/substrate combination, while supplying coolant directly to the substrate via manifold 720. FIG. 6b depicts an isolated view of manifold 720, with one manifold arm acting as a supply arm, being coupled to support 710 and in fluid communication therewith, with the other manifold arm likewise coupled to support 710, and acting as a return arm for coolant flow. As previously described in the preceding embodiment, coolant enters the supply arm of manifold 720, and splits upon entering support 710, flowing around either side of the cylindrical structure and then recombines within the return arm of manifold 720. It is apparent that the symmetrical configuration of the support/manifold combination would allow for an interchangability between the supply arm manifold and the return arm manifold. It will also be apparent to those skilled in the an that a single arm manifold 730 could act as both supply and return arm, as shown in FIG. 6c. As shown in FIG. 6c, coolant enters the supply side of manifold 730, flows circumferentially around support 710, and exits via the return side of manifold 730. Both the support/manifold combination of this embodiment, as well as the other two manifold embodiments, are designed to achieve maximum structural compliance, while supplying coolant directly to the target anode substrate.

It is understood that the above described description of various embodiments of the present invention is not limited to the specific forms shown. Modifications may be made in the design and arrangement of the elements without departing from the spirit of the invention as expressed in the appended claims.

What is claimed is:

1. A stationary target of an X-ray generating device for converting kinetic energy of a beam of high energy electrons into X-rays, comprising:

an anode button upon which the electron beam is directed, formed of a high Z material, said button having an X-ray producing section and a lip section, said lip section having greater lateral extent than said X-ray producing section and forming a stepped configuration therewith.

2. The stationary target of claim 1, wherein a diameter of said lip section is approximately twice exceeding a diameter of said X-ray producing section.

3. The stationary target of claim 2, further comprising a substrate formed of a low Z material, said substrate is attached to said lip section.

4. The stationary target of claim 3, wherein said substrate further comprises integral cooling channels.

5. The stationary target of claim 4, further comprising a support structure for housing said substrate to provide minimum resistance to said anode button when said anode button expands during X-ray production.

6. A stationary target of an X-ray generating device for converting kinetic energy of a beam of high energy electrons into X-rays comprising:

an anode button being comprised of a high Z material, said anode button having an X-ray producing section surrounded by an expansion gap within said anode button, a substrate having integral cooling channels, said substrate being adjacent to said anode button and comprised of a low Z material; and a support structure for having said substrate, said support structure having integral coolant supply and return channels, and a respective pair of supply and return plenum chambers with flexible baffles therebetween, said supply and return channels being operably coupled to plenum chambers for providing a coolant to said integral channels of said substrate.

7. The stationary target of claim 6, wherein, a diameter of said anode button is approximately twice exceeding a diameter of said X-ray producing section.

8. The stationary target of claim 7, wherein said baffles have a S configuration for providing flexibility to said support structure during radial expansion of said anode button.

9. The stationary target of claim 8, wherein said support structure is made of stainless steel.

10. A stationary target of an X-ray generating device comprising:

an anode button formed of a high Z material, said button having an X-ray producing section and a lip section, said lip section having greater lateral extent than said X-ray producing section and forming a stepped configuration therewith;

a substrate having integral channels, said substrate being comprised of a low Z material and adjacent to said anode button;

a support structure for housing said substrate; and a manifold being coupled to said support structure, said manifold having at least one arm.

11. The stationary target of claim 10, wherein said support structure further comprises a cylindrical support, and said at least one manifold arm comprises cooling channels for supplying coolant to said integral channels of said substrate via said manifold.

12. A support structure for flexible support of an anode assembly of an X-ray device comprising:

a body having flexible walls and an aperture for facilitating said anode assembly;

integral coolant supply and return channels disposed within said body;

supply and return plenum chambers being coupled to said integral coolant supply and return channels respectively for providing a coolant to said anode assembly; and flexible baffles disposed between said plenum supply and return chambers.

13. The support structure of claim 12, wherein said flexible baffles have a S configuration.

* * * * *